United States Patent [19]

Matthews

[11] 4,087,230

[45] May 2, 1978

[54] FUEL IGNITION SYSTEM PROVIDING FUEL SHUTOFF UNDER SIMULTANEOUS FAILURE CONDITIONS

[75] Inventor: Russell Byron Matthews, Goshen, Ind.

[73] Assignee: Johnson Controls, Inc., Milwaukee, Wis.

[21] Appl. No.: 684,543

[22] Filed: May 10, 1976

[51] Int. Cl.[2] ..... F23Q 9/08

[52] U.S. Cl. ..... 431/46; 431/43; 431/59

[58] Field of Search ..... 431/46, 43, 42, 59; 137/65, 66; 337/182, 183, 184, 377, 324

[56] References Cited

U.S. PATENT DOCUMENTS

| | | | |
|---|---|---|---|
| 1,596,836 | 8/1926 | Hoff | 431/43 |
| 2,722,977 | 11/1955 | Hotchkiss | 431/59 |
| 3,376,099 | 4/1968 | Giuffrida et al. | 431/46 X |
| 3,902,839 | 9/1975 | Matthews | 431/46 |

*Primary Examiner*—Kenneth W. Sprague
*Assistant Examiner*—Larry Jones
*Attorney, Agent, or Firm*—Emrich, Root, O'Keeffe & Lee

[57] ABSTRACT

A control arrangement for a fuel ignition system including redundant pilot and main valves, includes a thermal heat sensor mounted on a heat exchanger or in an exhaust stack of main burner apparatus and having a heating element which is energized in response to operation of thermostatically controlled contacts to close associated contacts to effect energization of the pilot valve permitting fuel to be supplied to a pilot outlet and the main valve which is operated when a pilot flame is established, the heating element being deenergized when the main valve is operated and the heat sensor being responsive to heat from the main burner to maintain the contacts closed maintaining the pilot valve energized. The heat sensor responds to a flame out condition to deenergize the pilot valve, thereby interrupting fuel flow to main valve.

23 Claims, 2 Drawing Figures

FUEL IGNITION SYSTEM PROVIDING FUEL SHUTOFF UNDER SIMULTANEOUS FAILURE CONDITIONS

BACKGROUND OF THE INVENTION

1. Field of the Invention

This invention relates to a fuel ignition system of the pilot ignition type employing a thermal heat sensor which is responsive to main burner heat and which effects the shutoff of the fuel supply to both pilot and main burners following flame-out under certain failure conditions.

2. Description of the Prior Art

Fuel ignition systems of the pilot ignition type, exemplified, for example, by the system shown in my U.S. Pat. No. 3,902,839, which was issued on Sept. 2, 1975, include a pilot valve which is operated in response to the closure of thermostatically controlled contacts to supply fuel to a pilot outlet for ignition by a suitable igniter to establish a pilot flame. A pilot flame sensing circuit detects the pilot flame and effects the energization of a main valve which supplies fuel to a main burner apparatus for ignition by the pilot flame. Typically, the operation of the main valve is controlled by a relay of the flame sensing circuit which has normally open contacts connected in the energizing path for the main valve.

In the event the pilot flame fails to be established within a predetermined time interval, the flame sensing circuit maintains the relay deenergized to prevent the main valve from operating. Also, in the event of a flame-out condition following a successful start-up, the flame sensing circuit effects deenergization of the relay to deenergize the main valve until the pilot flame is established.

However, should the relay contacts which control the energization of the main valve become welded together following a successful ignition cycle, then, in the event of a flame out condition, the deenergization of the relay of the flame sensing circuit will be ineffective to provide deenergization of the main valve. For such simultaneous failure conditions, both the pilot valve and the main valve will remain energized, and fuel will emanate from the pilot outlet and the main burner, an undesirable condition.

Therefore, it would be desirable to have a control arrangement for use in fuel ignition systems for effecting the deenergization of the pilot valve and the main valve under simultaneous failure conditions of the type noted above.

SUMMARY OF THE INVENTION

The present invention has provided a control arrangement for use in a fuel ignition system including pilot valve means operable when energized to supply fuel to a pilot outlet for ignition to establish a pilot flame, flame sensing means responsive to the pilot flame to effect the energization of a main valve means to supply fuel to a main burner apparatus for ignition to provide heat, and heat sensor means responsive to heat from the main burner apparatus to maintain the supply of fuel to the pilot outlet and the main burner apparatus. The heat sensor means is operable in the absence of heat from the main burner apparatus for a predetermined time to effect interruption of the supply of fuel to at least the main burner apparatus.

In accordance with a disclosed embodiment, the heat sensor means comprises a thermal heat switch which is mounted on a heat exchanger or in an exhaust stack of main burner apparatus and has a heating element which is energized in response to operation of thermostatically controlled contacts to close associated contacts to effect energization of the pilot valve means. When a pilot flame is established, the main valve means is energized in response to operation of a relay of a flame sensing means, and the heating element is deenergized by the flame sensing means. At such time, the contacts of the heat switch are maintained operated by heat from the main burner, maintaining the pilot valve means energized during the rest of the heat run.

The pilot valve means and the main valve means comprise a redundant valve assembly such that fuel is supplied to an inlet of the main valve means only when the pilot valve means is operated. The thermal heat switch responds to a flame-out condition to deenergize the pilot valve means thereby interrupting fuel flow to main valve means.

In the event of simultaneous failure conditions where the relay contacts which control the main valve means become welded together following a successful start up, then in the event of a flame out condition, cooling down of the heat exchanger or exhaust stack, permits the thermal heat switch to cool down opening associated contacts whereby the pilot valve is deenergized interrupting fuel flow to the main valve such that fuel flow to both the pilot outlet and the main burner is terminated.

In accordance with a further embodiment of the invention, which affords interlock on start up and interruption of fuel supply to both a pilot outlet and the main burner apparatus under the simultaneous failure conditions noted above, the thermal heat switch which controls the operation of the pilot valve means is in turn energized by an interlock means which includes switching means operable when enabled to interrupt the energizing path for the heating element of the thermal switch and to complete an energizing path for the pilot valve means, and delay means for energizing the switching means after a time interval following closure of thermostatically controlled contacts in response to a call for heat. The switching means prevents the reenergization of the heating element of the thermal switch until the thermostatically controlled contacts open to deactivate the system.

DESCRIPTION OF PREFERRED EMBODIMENTS

Figure 1:
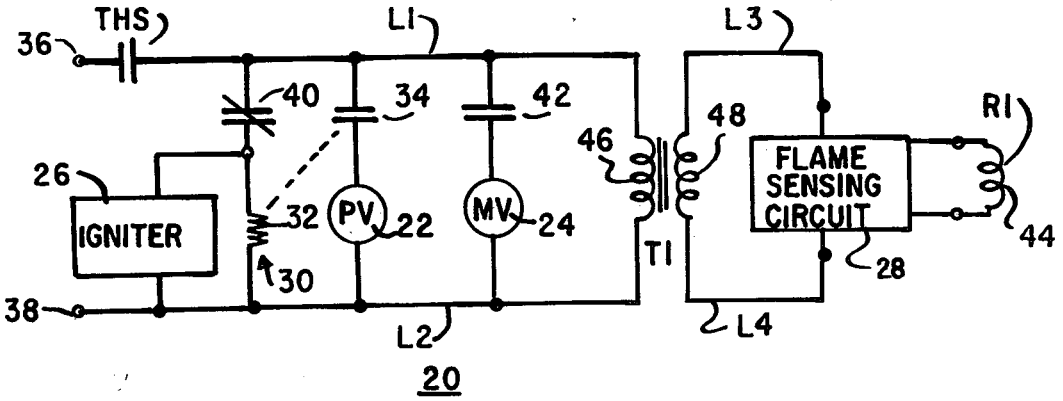
FIG. 1 is a schematic circuit diagram of a control circuit for a pilot ignition type fuel ignition system provided in accordance with one embodiment of the invention; and, FIG. 2 is a schematic circuit diagram of a control circuit for a pilot ignition type fuel ignition system provided in accordance with a further embodiment of the invention.

Referring to FIG. 1, which is a schematic circuit diagram of a control circuit for a fuel ignition system 20 of the pilot ignition type, the system 20 includes a pilot valve 22, a main valve 24, an igniter 26 and a flame sensing circuit 28. The pilot valve 22 is operable when energized to supply fuel to a pilot outlet for ignition by ignition sparks provided by the igniter 26 to establish a pilot flame. The flame sensing circuit 28 is operable when energized to sense the pilot flame and effect the energization of an associated relay R1, which operates to close normally open contacts 42 to effect energization of the main valve 24, which together with the pilot valve 22 comprises a redundant valve assembly. When the pilot valve 22 is operated, fuel is supplied to the main valve 24. Accordingly, when the main valve 24 operates, fuel is supplied to a main burner apparatus for ignition by the pilot flame.

In accordance with the present invention, the operation of the pilot valve 22 is controlled by a heat sensor switch 30. The heat sensor switch 30 includes a heater element 32, which is energized over normally closed contacts 40 of relay R1 of the flame sensing circuit 28 in response to the closing of thermostatically controlled contacts THS, and is operable when energized to close associated contacts 34 to effect energization of the pilot valve 22. When relay R1 operates following a successful startup, the main valve 24 is energized and a flame is established at the main burner, and the heater element 32 is deenergized. The heat sensor switch 30 may be mounted on the heat exchanger, in the exhaust stack or in the main burner of the heating apparatus to be responsive to heat from the main burner to maintain contacts 34 closed following deenergization of the heater element 32 to maintain the pilot valve 22 operated to supply fuel to the main valve 24.

In the event contacts 40 of the relay R1 are open at start up, either as a result of a failure of the flame sensing circuit 28 which permits the relay R1 to be energized in the absence of a pilot flame or for the condition where contacts 42 which control the main valve 24 become welded together, then, the normally closed contacts 40 of the relay R1 are maintained open, preventing energization of the heat sensor switch 30 when contacts THS close. Accordingly, the pilot valve 22 is maintained deenergized, preventing fuel flow to the main valve 24. Thus, even though contacts 42, which control the main valve 24, may be welded together so that the main valve 24 is energized in response to operation of contacts THS, fuel flow to the main burner apparatus is prevented since the pilot valve 22 is maintained deenergized for such condition.

Considering the control circuit for the fuel ignition system 20 in more detail, the heat sensor switch 30 may be a snap acting thermal time delay relay having automatic reset such as the Klixon Type "A" 60701 series which is manufactured by Texas Instrument, Inc. The heater element 32 of the heat sensor switch 30 is connected in series with normally closed contacts 40 of relay R1 of the flame sensing circuit 28 between conductors L1 and L2. Conductor L1 is connected over normally open thermostatically contacts THS to an input terminal 36 and conductor L2 is connected directly to a further input terminal 38. Terminals 36 and 38 are connectable to a source of 60Hz, 24 VAC.

The heat sensor switch 30 has normally open contacts 34 connected in series with the pilot valve 22 between conductors L1 and L2, permitting the pilot valve 22 to be energized whenever contacts 34 are closed. The heater element 32 is energized whenever thermostatically controlled contacts THS close, and contacts 40 of relay R1 are closed, and after a predetermined time interval, on the order of 15 seconds, causes a snap disc (not shown) which comprises normally open contacts 34 to snap over connecting the pilot valve 22 between conductors L1 and L2 for operation.

As indicated above, the pilot valve 22 and the main valve 24 comprise a redundant valve assembly. One example of a redundant valve assembly suitable for their application is disclosed in my U.S. patent application Ser. No. 630,166, which was filed on Nov. 10, 1975, now U.S. Pat. No. 4,044,794. In such assembly, fuel is supplied to the main valve 24 over the pilot valve 22, and accordingly, fuel supply to the main valve 24 is interrupted whenever the pilot valve 22 is deenergized.

The flame sensing circuit 28 is energized over a transformer T1 which has a primary winding 46 connected between conductors L1 and L2 and a secondary winding 48 connected between conductors L3 and L4 which are connected to input terminals of the flame sensing circuit 28. The flame sensing circuit 28 may be the type disclosed in U.S. Pat. No. 3,902,839, referenced above, and the operation of the flame sensing circuit is described in detail in such patent. Briefly, the flame sensing circuit includes a flame sensing electrode (not shown) which is positioned adjacent the pilot outlet, and a control circuit (not shown) which responds to the presence of a flame at the sensing electrode to effect energization of the operate winding 44 of relay R1 to open contacts 40 for deenergizing the heater element 32 of the heat sensor switch 30 and to close contacts 42 to connect the main valve 24 to conductors L1 and L2.

Relay R1 comprises a double pole, double throw relay (DPDT) with contacts 40 and 42 employing a common pole of the relay R1 such that whenever contacts 42 are closed, contacts 40 are open. Also, should contacts 42 become welded, contacts 40 cannot reclose.

The igniter 26 is connected in series with the normally closed contacts 40 of relay R1 between conductors L1 and L2 and is energized whenever thermostatically contacts THS close and contacts 40 are closed. The igniter 26 may be the type disclosed in U.S. Pat. No. 3,902,839 referenced above, and the manner manner in which the igniter 26 is operable to provide ignition sparks for igniting fuel emmanating from the pilot outlet is described in detail in the reference patent.

In operation, assuming contacts 40 of relay R1 are closed, then in response to the closure of contacts THS in response to a call for heat, the heat sensor heater 32 is energized and after a delay of approximately 15 seconds, the snap disc in the heat sensor 30 snaps over to complete the circuit for the pilot valve 22 which then operates to supply fuel to the pilot outlet. The igniter 26 is also energized at this time over normally closed contacts 40 of relay R1 to provide sparks for igniting fuel emanating from the pilot outlet to establish a pilot flame.

When a pilot flame is established, the flame sensing circuit 28 is operable to energize relay R1 which then operates to close contacts 42 for energizing the main valve 24 and to open contacts 40 to deenergize the heater element 32 and the igniter 26.

When the heater element 32 is deenergized, the heat sensor 30 begins to cool down. During the time it takes for the heat sensor 30 to cool sufficiently to permit contacts 34 to open, approximately 2 minutes for a 1 minute heating time, the main burner is supplying heat to the heat exchanger or exhaust stack. Accordingly, heat from the main burner maintains the heat sensor contacts 34 closed during the rest of the heat run.

In the event of a flame-out condition, the flame sensing circuit 28 deenergizes relay R1 such that contacts 42 open, deenergizing the main valve 24 and contacts 40 reclose, energizing the heat sensor heater 32 and the igniter 26, maintaining the pilot valve energized and permitting the igniter 26 to provide ignition sparks in the proximity of the pilot outlet. As soon as the pilot fuel is reignited, the flame sensing circuit 28 reenergizes relay R1 which operates to close contacts 42 to energize the main valve 26 and to open contacts 40 to deenergize the heater element 32 and the igniter 26.

When heating demand has been met, the pilot valve 22 and the main valve 24 are deenergized when thermostatically controlled contacts THS open, interrupting the supply of fuel to the fuel outlets so that the flame is extinguished. When the flame is extinguished, the heat sensor 30 cools down permitting contacts 34 to open. The flame sensing circuit 28 is also deenergized, causing relay R1 to be deenergized and permitting contacts 42, which control the operation of the main valve 24, to open and contacts 40, which are connected in the energizing circuit for the heater element 32 of the heat sensor switch 30 and the igniter 26 to close, and the system is prepared for the next heating cycle.

In the event of the simultaneous failure conditions noted above, that is where the contacts 42 which control the main valve 24 become welded together following a successful start up, then in the event of a flame out condition, cooling down of the heat exchanger or exhaust stack, permits the heat sensor 30 to cool down opening contacts 34. The flame sensing circuit 28 responds to the loss of flame to deenergize relay R1. However, contacts 40 of the DPDT relay R1 cannot reclose to reenergize the heater element 32. Thus, the heater element 36 is permitted to cool down and open contacts 34. When contacts 34 open, the pilot valve 22 is deenergized interrupting fuel flow to the main valve 24, of the redundant valve assembly, terminating fuel flow to both the pilot outlet and the main burner and maintaining the system 20 in a lock out state.

Figure 2:
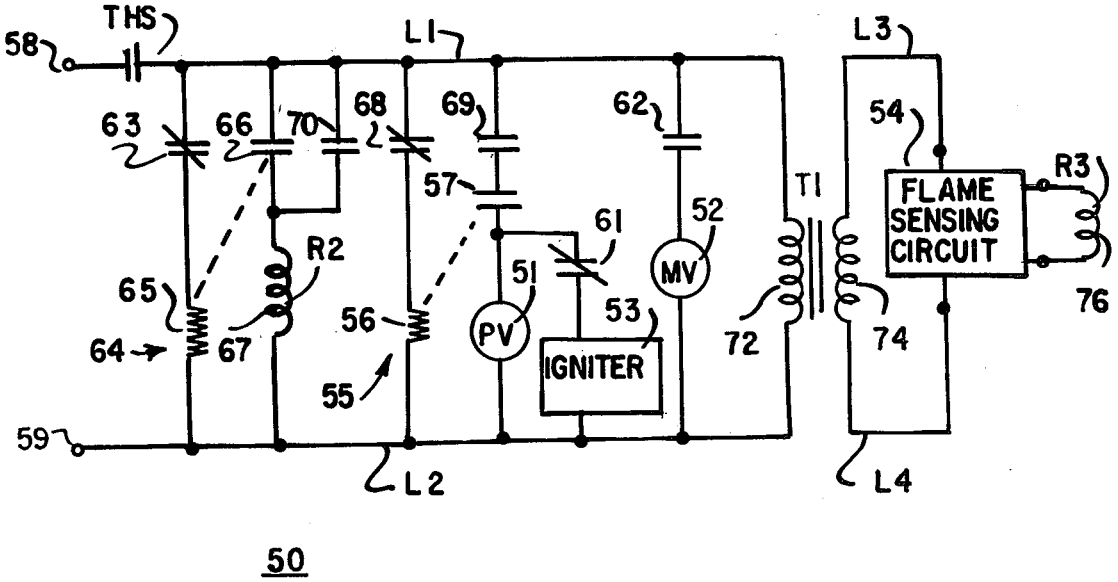

Referring to FIG. 2, there is shown a schematic circuit diagram of a control circuit for a fuel ignition system 50 provided in accordance with a further embodiment of the invention. The control circuit provides an interlock on start up and interrupts fuel supply to both the pilot outlet and the main burner under the simultaneous failure conditions noted above.

The system 50, which is generally similar to the system 20 of FIG. 1, includes pilot valve 51, a main valve 52, an igniter 53, and a flame sensing circuit 54 including a relay R3, which is a double pole, double throw relay similar to relay R1 shown in FIG. 1. The pilot valve 51 and the main valve 52 comprise a redundant valve assembly and may be the type disclosed in my U.S. patent application, Ser. No. 630,166 referred to above. Now U.S. Pat. No. 4,044,794.

The control circuit further includes a heat sensor switch 55, which controls the operation of the pilot valve 51, and a warp switch 64 and a relay R2 which provide an interlock on start up to prevent activation of the system 50 whenever contacts 62 of relay R3 are welded together or for a failure of flame sensing circuit 54 which permits relay R3 to be energized in the absence of a flame.

The warp switch 64 has a heater element 65 connected in series with normally closed contacts 63 of relay R3 of the flame sensing circuit 54 between conductors L1 and L2. Contacts 62 and 63 of relay R3 employ a common pole of the relay R3 and accordingly, whenever contacts 62 are closed, contacts 63 are open. Also, should contacts 62 become welded, contacts 63 cannot reclose.

Whenever thermostatically controlled contacts THS close to connect power supplied to the circuit over terminals 58 and 59 to conductors L1 and L2, the heater element 65 is energized, if contacts 63 are closed, and after a predetermined time interval, on the order of 30 seconds, the warp switch 64 is operable to close normally open contacts 66 which are connected in series with the operate coil 67 of relay R2 between conductors L1 and L2. Relay R2 has normally open contacts 70 which provide a holding path for the relay R2 whenever the relay R2 is operated.

The heat sensor switch 55, which may be the snap acting thermal heat time delay relay employed in the system 20 of FIG. 1, has a heater element 56 connected in series with normally closed contacts 68 of relay R2 between conductors L1 and L2. The heater element 56 is energized whenever thermostatically controlled contacts THS close, and after a predetermined time interval, on the order of 15 seconds, causes the snap disc to operate normally open contacts 57 which are connected in series with the pilot valve 51 and normally open contacts 69 of relay R2 between conductors L1 and L2.

The heat sensor switch 55 may be mounted on the heat exchanger or in the exhaust stack or main burner of the heating apparatus to be responsive to heat from the main burner to maintain contacts 57 closed following deenergization of the heater element 56 in response to operation of relay R2, to thereby maintain the pilot valve 51 operated. In the event of a flame-out condition, or failure to establish a pilot flame, the loss or lack of main burner heat permits the heat sensor switch 55 to cool down whereby contacts 57 open, deenergizing the pilot valve 51 and interrupting fuel flow to the main valve 52 of the redundant valve assembly, preventing fuel flow to the pilot outlet and the main burner.

In operation, in response to the closure of contacts THS, the warp switch heater 65 is energized over normally closed contacts 63 of relay R3, and the sensor heater element 56 is energized over normally closed contacts 68 of relay R2. After a time interval of approximately 15 seconds, following closure of contacts THS, the sensor heater element 56 causes the snap disc to snap over, closing contacts 57 to prepare an energizing circuit for the pilot valve 51 and the igniter 53. The warp switch heater 65 causes associated contacts 66 to close at a time approximately 30 seconds following closure of contacts THS, to complete an energizing circuit for relay R2 which then operates.

When relay R2 operates, a holding path is provided for relay R2 over its contacts 70, the heat sensor heater 56 is deenergized when contacts 68 open, and the closure of contacts 69 effects the energization of the pilot valve 51 and the igniter 53.

When the pilot valve 51 operates, fuel is supplied to the pilot outlet for ignition by sparks provided by the igniter 53. When a pilot flame is established, the flame sensing circuit 54 operates relay R3 which opens contacts 61 and 63 deenergizing the igniter 53 and the warp switch heater 65, and closing contacts 62 which permits the main valve 52 to be energized to supply fuel to the main burner for ignition by the pilot flame.

It is pointed out that when relay R2 operates to open contacts 68, heater 56 is deenergized and begins to cool. However, if pilot ignition occurs, and the main valve 52 is energized, then heat from the main burner acting on the heat exchanger or the exhaust stack or from the main burner flame itself maintains the contacts 57 of the heat sensor 55 closed thereby maintaining pilot valve 51 operated. If the main burner heat is not sensed by the heat sensor 55 within the cooling time of the heating element 56, the heater element 56 cools down sufficiently to permit the snap disc to operate to open contacts 57, interrupting the energizing circuit for the pilot valve 51 which then releases, cutting off the supply of fuel to the main valve 52.

For the condition where the pilot flame fails to be established, the main valve 52 is not operated, and no heating is provided by the main burner. Accordingly, since relay R2 deenergizes the heater element 56 of the heat sensor 55, then, after the cooling time for the heat element 56, contacts 57 open, deenergizing the pilot valve 51 and shutting off fuel supply to the pilot outlet.

In the event of the simultaneous failure conditions noted above, that is where the contacts 62 which control the main valve 52 become welded together following a successful start up, then in the event of a flame out condition, cooling down of the heat exchanger or exhaust stack, permits the heat sensor 55 to cool down opening contacts 57. The flame sensing circuit 54 responds to the loss of flame to deenergize relay R3. However, since relay R2 is maintained operated over the holding path provided by contacts 70, contacts 68, which are connected in series with heater element 56 of the heat sensor 55 are maintained open preventing reenergization of the heater element 56. Thus, the heat sensor 55 cools down and opens contacts 57 to deenergize the pilot valve 51 interrupting fuel flow to the main valve 52 of the redundant valve assembly. Accordingly, fuel flow to both the pilot outlet and the main burner is terminated.

Thus, in the system 50 shown in FIG. 2, the warp switch 64 provides the contact interlock protection and relay R2 proves the integrity of the warp switch heater 65. The heat sensor 55 provides 100% shut down of fuel supply in the event a pilot flame is not established. In addition, the heat sensor 55 also provides a safe shut down in the care of the simultaneous failure condition previously described.

While the embodiments for the fuel ignition systems 20 and 50 shown in FIGS. 1 and 2 employ redundant pilot and main valves, and the operation of the pilot valve is controlled by a heat sensor switch, it is apparent that with suitable modification, the systems may employ a separate pilot valve and the main valve. For example, when the system 20 shown in FIG. 1 is used in an application employing natural gas as the fuel, the heat sensor contacts 37 may be connected in series with the main valve 32, and the pilot valve 31, may be connected directly between conductors L1 and L2. Alternately, the heat sensor contacts 37 may be connected in series with conductor L2 to provide an energizing path for the pilot valve and the main valve upon closure of the contacts 37. The manner of operation of circuits as modified is apparent from the foregoing description.

I claim:

1. In a fuel ignition system including pilot valve means operable when energized to supply fuel to a pilot outlet for ignition by an ignition means to establish a pilot flame, main valve means operable when energized to supply fuel to a main burner apparatus for ignition by the pilot flame to provide heat, and flame sensing means responsive to the establishment of a pilot flame for energizing said main valve means, a control arrangement comprising heat sensor means operable when energized to provide an energizing path for at least one of said valve means, activate means reponsive to a request for heat to energize said heat sensor means and to effect the energization of said pilot valve means to supply fuel to said pilot outlet, said flame sensing means being responsive to the establishment of a pilot flame to effect the energization of said main valve means to supply fuel to said main burner apparatus, and to effect deenergization of said heat sensor means, said heat sensor means thereafter being maintained operated responsive to heat from said main burner apparatus to maintain the supply of fuel to said pilot outlet and said main burner apparatus, and being operable in the absence of heat from said main burner apparatus for a predetermined time to effect interruption of the supply of fuel to at least said main burner apparatus.

2. A system as set forth in claim 1 wherein said heat sensor means includes thermal switch means having normally open contacts connected in an energizing path for at least said one valve means, and heating element means responsive to said activate means to cause said contacts to close to permit the energization of said one valve means.

3. A system as set forth in claim 2 wherein said flame sensing means effects deenergization of said heating element means, said thermal switch means being maintained operated by main burner heat.

4. A system as set forth in claim 3 wherein said contacts are connected in energizing path for said pilot valve means.

5. In a fuel ignition system including pilot valve means operable when energized to supply fuel to a pilot outlet for ignition by an ignition means to establish a pilot flame, main valve means operable when energized to supply fuel to a main burner apparatus for ignition by the pilot flame to provide heat, and flame sensing means responsive to the establishment of a pilot flame for energizing said main valve means, a control arrangement comprising control means including heat sensor means having a heating element means and normally open contacts, said heating element means being energized in response to a request signal to cause said contacts to close to permit said pilot valve means to be energized to supply fuel to said pilot outlet, said flame sensing means being responsive to the establishment of a pilot flame to effect the energization of said main valve means to supply fuel to said main burner apparatus, and to effect the deenergization of said heating element means, and thereafter, said heat sensor means being responsive to heat from said main burner apparatus when said heating element means is deenergized to maintain said contacts closed to thereby maintain the supply of fuel to said pilot outlet and said main burner apparatus, and operable in the absence of heat from said main burner apparatus for a predetermined time to permit said contacts to open to cause the supply of fuel to said pilot outlet and said main burner apparatus to be interrupted.

6. A system as set forth in claim 5 wherein said heat sensor means is mounted on a heat exchanger means of said main burner apparatus.

7. A system as set forth in claim 5 wherein said heat sensor means is mounted in an exhaust stack of said main burner apparatus.

8. A system as set forth in claim 5 wherein said heat sensor means is mounted in the proximity of the main burner flame.

9. A system as set forth in claim 5 wherein said pilot valve means and said main valve means comprise a redundant valve assembly, said pilot valve means being operable when energized to supply fuel to an inlet of said main valve means, and said heat sensor means is operable in response to the absence of heat from said main burner apparatus for said predetermined time to effect deenergization of said pilot valve means to thereby interrupt fuel flow to said main valve means.

10. A system as set forth in claim 5 wherein said control means further includes interlock means for delaying the energization of said pilot valve means for a time interval following the occurrence of said request signal and for deenergizing said heating element means to cause said heat sensor means to effect deenergization of said pilot valve means in the absence of heat from said main burner apparatus within a predetermined time following the establishment of a pilot flame.

11. A system as set forth in claim 10 wherein said interlock means prevents the reenergization of said heating element means whenever said request signal continues to be provided following the deenergization of said pilot valve means by said heat sensor means.

12. A system as set forth in claim 10 wherein said interlock means includes switching means operable when energized to interrupt the energizing path for said heating element means and to complete an energizing path for said pilot valve means, and delay means responsive to said request signal for energizing said switching means after said time interval.

13. A system as set forth in claim 5 wherein said flame sensing means includes a normally deenergized relay having normally open contacts connected in an energizing path for said main valve means, said relay being operated to close said contacts to effect energization of said main valve means whenever a pilot flame is established, said control means causing interruption of fuel flow to said main burner apparatus following a flame out condition in the event said relay contacts become welded together.

14. A system as set forth in claim 12 wherein said delay means includes a thermal heat switch having a heating element which is energized in response to said request signal to operate associated contacts which are connected in an energizing path for said switching means.

15. In a fuel ignition system including redundant valve means having a pilot valve means and main valve means, said pilot valve being operable when energized to supply fuel to an inlet of said main valve means and to a pilot outlet for ignition by an ignition means to establish a pilot flame, said main valve means being operable when energized to supply fuel provided to said inlet to a main burner apparatus for ignition by the pilot flame to provide heat, and flame sensing means responsive to the establishment of a pilot flame for energizing said main valve means, a control arrangement comprising heat sensor means including a heating element means and normally open contacts connected in an energizing path for said pilot valve means, said heating element means being energized in response to a request signal to close said contacts to effect energization of said pilot valve means, permitting fuel to be supplied to said pilot outlet, said flame sensing means being responsive to the establishment of a pilot flame to energize said main valve means to supply fuel to said main burner apparatus and to effect the deenergization of said heating element means, and thereafter, said heat sensor means being responsive to heat from said main burner apparatus when said heating element means is deenergized to maintain said contacts closed to thereby maintain said pilot valve means energized, and operable in the absence of heat for a predetermined time to permit said contacts to open to thereby deenergize said pilot valve means, thereby interrupting fuel flow to said main valve means.

16. A system as set forth in claim 15 wherein said heating element means is connected in an energizing path with first normally closed contacts of a relay of said flame sensing means, said relay being operated to open said first contacts when the pilot flame is established to thereby deenergize said heating element means.

17. A system as set forth in claim 16 wherein said relay has second normally open contacts connected in an energizing path for said main valve means and operated to complete said energizing path for said main valve means whenever said relay is energized, said flame sensing means responding to a flame-out condition to deenergize said relay to open said second contacts for deenergizing said main valve means, and said heat sensor means being operable to open its associated contacts to deenergize said pilot valve means interrupting fuel flow to said inlet of said main valve means following a flame-out condition in the event said second contacts become welded together.

18. In a fuel ignition system including redundant valve means having a pilot valve means and a main valve means, said pilot valve means being operable when energized to supply fuel to an inlet of said main valve means and to a pilot outlet for ignition by an ignition means to establish a pilot flame, said main valve means being operable when energized to supply fuel provided to said inlet to a main burner apparatus for ignition by the pilot flame, a control arrangement comprising heat sensor means including heating element means energized in response to a request signal to operate associated contacts for preparing an energizing path for said pilot valve means, control means responsive to said request signal to complete said energizing path for said pilot valve means to effect energization of said pilot valve means, and to interrupt the energizing path for said heating element means at a predetermined time following the occurrence of said request signal, said flame sensing means being responsive to the establishment of a pilot flame to effect energization of said main valve means, said heat sensor means being responsive to heat from the main burner apparatus for maintaining said contacts closed to maintain said pilot valve means operated, said heat sensor means being operable after a predetermined time delay following the absence of heat from said main burner apparatus to permit said contacts to open causing said pilot valve means to be deenergized to thereby interrupt fuel flow to said main valve means.

19. A system as set forth in claim 18 wherein said control means includes interlock means for delaying the energization of said pilot valve means for a time interval following the occurrence of said request signal and for permitting said heat sensor means to effect deenergization of said pilot valve means in the absence of heat from said main burner apparatus within a predetermined time following the establishment of a pilot flame.

20. A system as set forth in claim 19 wherein said interlock means includes switching means operable when enabled to interrupt the energizing path for said heating element means and to complete said energizing path for said pilot valve means, and delay means responsive to said request signal for energizing said switching means after said time interval.

21. A system as set forth in claim 20 wherein said switching means prevents the reenergization of said heating element means whenever said request signal continues to be provided following the deenergization of said pilot valve means by said heat sensor means.

22. A system as set forth in claim 20 wherein said delay means includes a thermal heat switch having a heating element which is energized in response to said request signal to operate associated contacts which are connected in an enabling path for said switching means.

23. A system as set forth in claim 18 wherein said flame sensing means includes a normally deenergized relay having normally open contacts connected in an energizing path for said main valve means, said relay being operated to close said contacts to effect energization of said main valve means whenever a pilot flame is established, said flame sensing means responding to a flame-out condition to deenergize said relay to open said relay contacts for deenergizing said main valve means, and said heat sensor means being operable to open its associated contacts to deenergize said pilot valve means interrupting fuel flow to said inlet of said main valve means following a flame-out condition in the event said relay contacts become welded together.

* * * * *